US010501876B2

(12) United States Patent
Ewert et al.

(10) Patent No.: US 10,501,876 B2
(45) Date of Patent: Dec. 10, 2019

(54) HIGHLY FUNCTIONAL SPUNBONDED FABRIC MADE FROM PARTICLE-CONTAINING FIBRES AND METHOD FOR PRODUCING SAME

(71) Applicant: Thüringisches Institut Für Textil-Und Kunststoff-Forschung E.V., Rudolstadt (DE)

(72) Inventors: Yvonne Ewert, Rudolstadt (DE); Frank-Günter Niemz, Rudolstadt (DE); Marcus Krieg, Weimar (DE); Bernd Riedel, Unterwellenborn (DE)

(73) Assignee: THUERINGISCHES INSTITUT FUER TEXTIL-UND KUNSTSTOFF-FORSCHUNG E.V., Rudolstadt (DE)

( * ) Notice: Subject to any disclaimer, the term of this patent is extended or adjusted under 35 U.S.C. 154(b) by 0 days.

(21) Appl. No.: 16/026,273

(22) Filed: Jul. 3, 2018

(65) Prior Publication Data

US 2018/0313010 A1 Nov. 1, 2018

Related U.S. Application Data

(63) Continuation-in-part of application No. 13/504,567, filed as application No. PCT/EP2011/004591 on Sep. 13, 2011, now abandoned.

(30) Foreign Application Priority Data

Sep. 14, 2010 (DE) ..... 10 2010 045 242

(51) Int. Cl.

| | |
|---|---|
| ***D04H 3/16*** | (2006.01) |
| ***D01D 5/14*** | (2006.01) |
| ***D01F 1/10*** | (2006.01) |
| ***D01D 5/06*** | (2006.01) |
| ***D04H 3/018*** | (2012.01) |
| ***D04H 3/007*** | (2012.01) |
| ***D04H 3/005*** | (2012.01) |
| ***D04H 3/013*** | (2012.01) |
| ***D04H 3/02*** | (2006.01) |
| *D01F 11/02* | (2006.01) |
| *D01F 2/02* | (2006.01) |

(52) U.S. Cl.

CPC ..... *D04H 3/16* (2013.01); *D01D 5/06* (2013.01); *D01D 5/14* (2013.01); *D01F 1/10* (2013.01); *D04H 3/005* (2013.01); *D04H 3/007* (2013.01); *D04H 3/013* (2013.01); *D04H 3/018* (2013.01); *D04H 3/02* (2013.01); *D01F 2/02* (2013.01); *D01F 11/02* (2013.01)

(58) Field of Classification Search

CPC .... C08F 212/10; C08F 220/44; C08F 222/08; C09D 125/14

See application file for complete search history.

(56) References Cited

U.S. PATENT DOCUMENTS

| | | | | |
|---|---|---|---|---|
| 3,422,176 A | | 1/1969 | Jamison | |
| 3,468,841 A | | 9/1969 | Corbiere et al. | |
| 3,971,373 A | * | 7/1976 | Braun | A62B 23/025 128/206.19 |
| 4,447,568 A | | 5/1984 | Stern et al. | |
| 9,303,335 B2 | | 4/2016 | Kolbe et al. | |
| 2009/0057296 A1 | | 3/2009 | Niemz et al. | |
| 2010/0080993 A1 | | 4/2010 | Privitera et al. | |
| 2012/0058166 A1 | * | 3/2012 | Glenn, Jr. | D01F 1/10 424/401 |

FOREIGN PATENT DOCUMENTS

| | | | |
|---|---|---|---|
| EP | 0110223 A2 | | 6/1984 |
| EP | 1199393 A2 | | 4/2002 |
| GB | 299291 | * | 4/1928 |
| JE | 102008045290 A1 | | 4/2010 |
| WO | 2005098119 A1 | | 10/2005 |

OTHER PUBLICATIONS

Textile Worlds (Spunbond & Meltblown nonwovens May-Jun. 2008) (Year: 2008).*

Williams et al. (Elements (Que), Apr. 1, 2009; 5(2): 99-104).

Textile Worlds (Spunbond & Meltblown nonwovens May-Jun. 2008).

International Search Report of PCT/EP2001/004591 dated Nov. 24, 2011, 6 pages.

* cited by examiner

*Primary Examiner* — Anna R Falkowitz

(74) *Attorney, Agent, or Firm* — ProPat, LLC; Cathy R. Moore

(57) ABSTRACT

Functional spunlaid fabrics incorporating fibers made from non-meltable polymers containing permanently one or more functional additives are provided. The fibers are entangled and interlocked to form a firm nonwoven composite, have different lengths, and aspect ratios above 1,000. The fibers have a mean diameter of 0.1 to 500 micrometres and diameter variations within a single fiber and among each other of at least 30%. The fibers contain more than 40 wt % of finely distributed functional additives in solid and/or liquid form. The spunlaid fabric is produced from a spinning solution containing the non-meltable polymer dissolved in a direct solvent and at least one functional additive. The spinning solution is extruded out of a spinneret, and the resulting strands are drawn in the longitudinal direction to form fibers, stabilized and laid down to form a nonwoven fabric with permanent functional properties. Exemplary spunlaid fabrics include clothing, technical textiles and filters.

18 Claims, 9 Drawing Sheets

OMPG 100μm Mag= 30x
Probe: 14/08 Nr. 1 0,08nbar HV=15.00 kV Working distance= 11mm OMPG 20μm Mag= 150x
Probe: 14/08 Nr. 1 0,08nbar HV=15.00 kV Working distance= 11mm OMPG 100μm Mag= 30x
Probe: 14/08 Nr. 2 0,2 bar HV=15.00 kV Working distance= 10mm OMPG 10μm Mag= 150x
Probe: 14/08 Nr. 2 0,2 bar HV=15.00 kV Working distance= 10mm OMPG 100μm Mag= 30x
Probe: 14/08 Nr. 2 HV=15.00 kV Working distance= 9mm 20μm EHT= 1.00kV Signal A= SE2 Date: 17 Mar 2016
WD= 4.7 mm Mag= 1.00 KX Stage at T= 0.0°

100μm EHT= 1.00kV Signal A= SE2 Date: 1 Feb 2017
WD= 4.8 mm Mag= 500 X Stage at T= 0.0°

10μm EHT= 1.00kV Signal A= SE2 Date: 1 Feb 2017
WD= 4.7 mm Mag= 5.00 KX Stage at T= 0.0°

10μm EHT= 1.00kV Signal A= SE2 Date: 1 Feb 2017
WD= 4.8 mm Mag= 2.50 KX Stage at T= 0.0

200μm EHT= 2.00kV Signal A= SE2 Date: 1 Feb 2017
WD= 4.6 mm Mag= 250 X Stage at T= 0.0°

HIGHLY FUNCTIONAL SPUNBONDED FABRIC MADE FROM PARTICLE-CONTAINING FIBRES AND METHOD FOR PRODUCING SAME

CROSS REFERENCE TO RELATED APPLICATIONS

This application is being filed as a Continuation-in-Part of U.S. application Ser. No. 13/504,567, filed Apr. 27, 2012 which was a National Stage Application of International Application No PCT/EP2011/004591 filed Sep. 13, 2011, which further claimed priority to parent application German Patent Application No. 10 2010 045 242.4, filed Sep. 14, 2010. Each of U.S. application Ser. No. 13/504,567; International Application No. PCT/EP2011/004591 and German Patent Application No. 10 2010 045 242.4 are hereby incorporated by reference herein in their entirety.

FIELD OF THE INVENTION

The invention relates to high-functionality spunlaids as textile fabrics which are obtainable directly from dissolved polymers using known spunlaid processes and which are constructed of fibrous elements filled with liquid and/or solid functional additives. The inventive fibrous elements have a nonuniform appearance. They differ in lengths and diameters and are referred to herein as fibers. The fibers consist of functional additive to an extent of more than 40 wt %, based on total fiber weight, the average fiber diameter is in the range from 0.1 to 500 micrometers, and diameter fluctuations not only between fibers but also within one fiber amount to at least 30% caused by the high amount of additives in the fibers. The spunlaid has high functionality due to very high concentrations of functional additives and is versatile in use, for example as interlining, for hygiene applications, for wound dressings, as carrier materials, as building and transportation material or as a filter. The functionality is long-lasting because the additives are incorporated in the fibers permanently.

BACKGROUND OF THE INVENTION

Filled textile fabrics, for example those having thermoregulating, antimicrobial or absorbent properties, are already known.

Prior art materials used in the form of textile fabrics require at least one additional processing step after the production of functional fibers, and/or contain only small amounts of functional particles. DE 10 2008 045290 A1 for example discloses fibers which are then used to produce textiles, wound dressings, filters, etc. Additive fractions are exclusively limited to zinc white (ZnO and ZnS), the fraction of which is limited to a maximum of 30%, while particle sizes are less than 15 μm. It is mentioned that the particle content can also be higher for fibrous nonwoven applications, but no teaching is communicated as to how such nonwoven fabrics are obtainable. The object was not a functional fibrous nonwoven having a high particle content, but washable and dyeable bactericidal moldings/fibers combining controlled delivery of active ingredients with prescribed durability to washing.

Carrier material often utilizes thermoplastically processable polymers whose melts can be processed into a spunlaid, for example in EP 1 199 393 A2. A spunlaid produced from thermoplastic polymers with hydrophobic admixtures is concerned there. The purpose is to concentrate the hydrophobic admixtures at the fiber surface. This is achieved by the fiber being drawn by the air stream to such an extent that the average fiber diameter is equal to the particle diameter or decreases up to at most half the particle diameter. The fraction of masterbatches with the mixture agents is between 10 and 20 wt % and must not be higher so as not to impair the further processing into roofing membranes or the use in sanitary napkins.

Particle-containing filaments/fibers are not consistently obtainable in normal filament/fiber-spinning processes when the fraction of functional particles is very high at not less than 40%, since broken ends would be a frequent consequence.

Various sectors of the textile industry have a high need for fiber materials with additional functional benefit for the consumer, which shall also be inexpensive to produce and easy to process. Application sectors for such fiber materials include for example as interlining material in the apparel industry, industrial textiles, for example hygiene applications, wound dressings, as carrier materials, as building and transportation material, as insulation material, as cosmetic material or as filters, for example for the filtration of wastewater or exit air and binding of air and water ingredients.

Fabrics comprising functional additives are obtainable in principle either by fabric production along a textile value-added chain or fibrous nonwoven formation in each case from functionally additized fibers, the coating of sheetlike textile structures with additive dispersions or the incorporation of solid or liquid functional additives in already produced fibrous nonwoven structures.

Fibers having a fraction of functional additives which amounts to more than 40 wt % are not consistently obtainable in normal fiber-spinning processes, since broken fibers are a frequent consequence. Although this disadvantage can be partly redeemed in the use of functional fibers fabricated via solution spinning, the subsequent textile fabric production processes also always require a minimum strength and at least one additional processing step.

Prior art materials produced in the form of functional textile fabrics require at least one additional processing step following a separate production of functional fibers, and/or contain only small amounts of functional particles. The separate operation to produce a fibrous nonwoven imposes an additional stress on the highly filled fibers and as a result these are damaged and only meet comparatively low-quality requirements in respect of functionality and/or mechanical durability.

SUMMARY OF ADVANTAGEOUS INVENTIVE EMBODIMENTS

The present invention has for its purpose to provide a versatile fabric comprising particle-containing fibers with permanent high functional benefit for various use sectors, depending on the nature of the functional particles, wherein the particle-containing fibers consist of functional additives to an extent of more than 40 wt % and have an average diameter in the range from 0.1 to 500 micrometers. The fabrics shall be sufficiently strong as-laid that they are suitable for further processing and/or direct use. Owing to the high fractions of functional admixtures, these fabrics shall have such functional properties as are otherwise only achievable through additional process steps that may be omitted in the present invention, such as coating or surface finishing.

These objects are achieved according to the present invention when directly in the spinning process a high-functionality textile fabric is produced continuously from a solution of nonmeltable polymers in direct solvents which is doped with one or more functional admixture agents, using a spunbond process. Surprisingly, textile fabrics having an additive content of more than 40 wt % are consistently and reproducibly obtainable without additional process steps and retain permanent functionality throughout their entire life cycle. It was similarly found that the fibrous nonwoven nonwoven fabric fibers of the present invention have diameter fluctuations of at least 30% within and between fiber and, as a surprising result, have a high self-binding capacity through entangling and intertwining.

DETAILED DESCRIPTION OF ADVANTAGEOUS EMBODIMENTS

The present invention accordingly provides a high-functionality spunlaid nonwoven of fibers based on nonmeltable polymers containing one or more functional additives, characterized in that the fibers are intertwined and entangled, have a differing length with aspect ratios above 1000 and form a firmly interbonded nonwoven, wherein the fibers have an average diameter of 0.1 to 500 micrometers and also diameter fluctuations of at least 30% within any one fiber and between fibers and wherein the fibers in addition to the nonmeltable polymer contain more than 40 wt %, based on total fiber weight, of functional additives in solid and/or liquid form which are finely distributed in the fibers. The highly filled fibers according to the present invention normally are typically formed through spinnerets having circular die holes, and thus the resulting fibers would be expected to have an about cylindrical shape and an about circular cross-section. The extreme, nonuniform, random diameter fluctuations of the inventive fibers thus pertain to fibers which, if unfilled, would have such a cylindrical shape. Hence for ease of discussion, fiber thickness fluctuations are referred herein as "diameter" fluctuations. In alternative embodiments; however, the extreme, nonuniform, random thickness (i.e. "diameter") fluctuations of the inventive fibers could pertain to fibers which, if unfilled, would have other geometric shapes, such as a triangular shape, multilobal shape, or the like. Exemplary random diameter fluctuations range from 0 to 5% of the mean fiber diameter. In contrast, the inventive fibers exhibit random fluctuations ranging from 15 to greater than 60% of the mean fiber diameter, such as a 20 to greater than 40% random fiber diameter fluctuation, particularly greater than a 30% random fiber diameter fluctuation, all based upon the mean diameter of a single fiber. In contrast, conventional unfilled fibers typically have a fiber diameter variation of 10% or less. In case of fibers having a shape other than circular, the area of the cross-section should be determined and translated into the area of a cross-section of a fiber having a cylindrical shape or other appropriate mathematical algorithm applied to determine the fiber thickness fluctuation.

Figure 1:
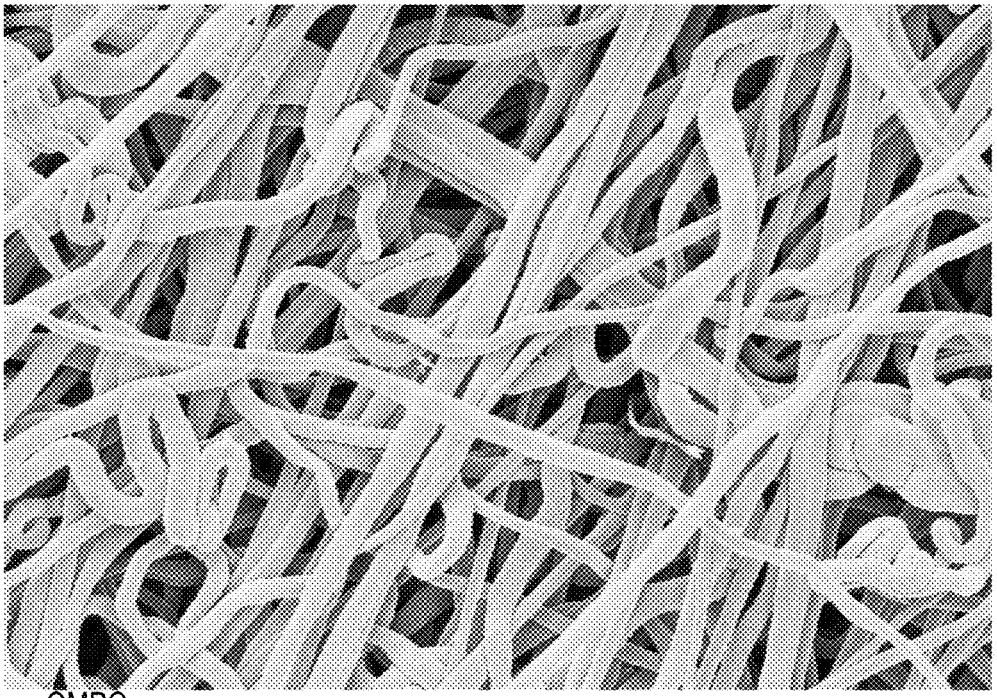
FIG. 1 is an SEM image of an exemplary inventive nonwoven.
Figure 2:
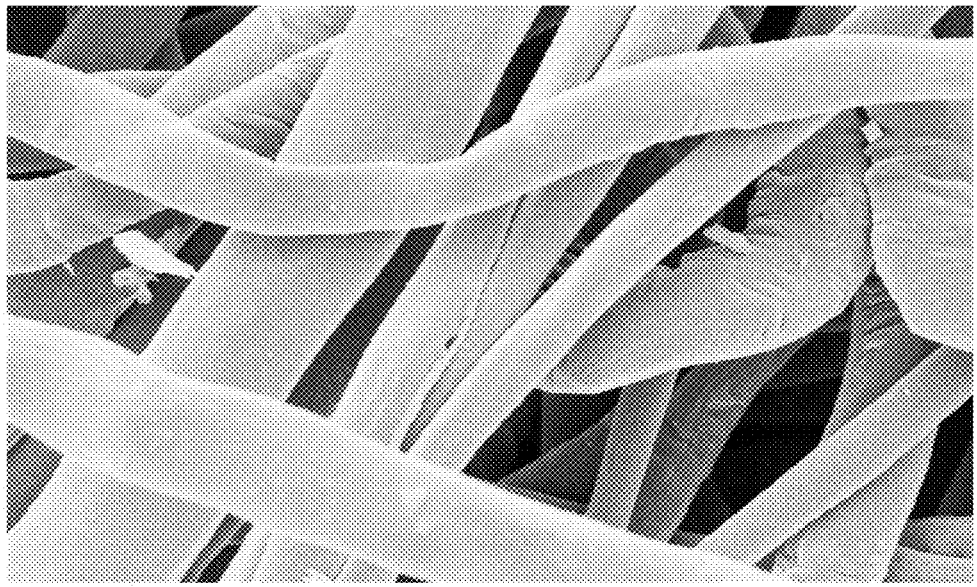
FIG. 2 is a more magnified SEM image of fibers within an exemplary inventive nonwoven.
Figure 3:
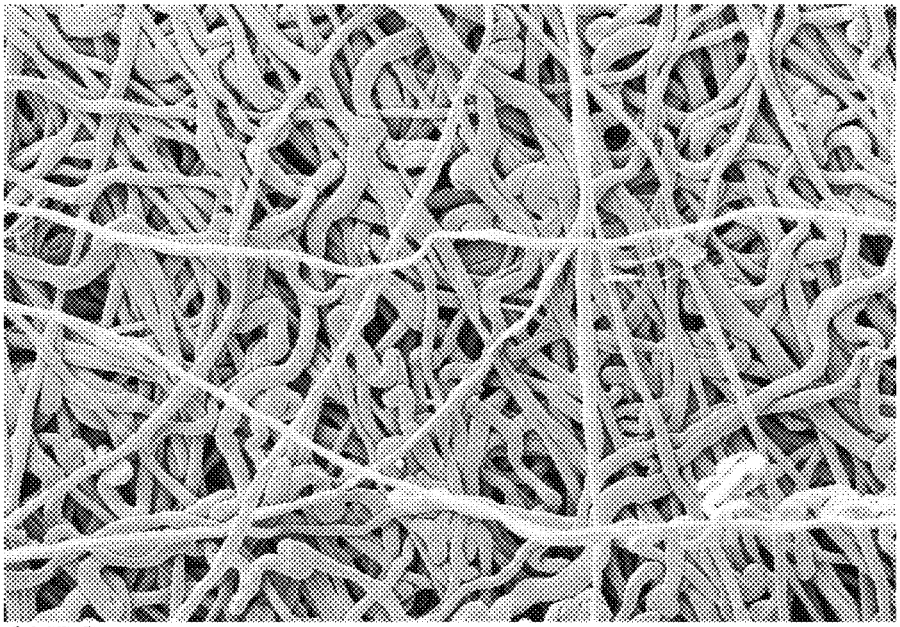
FIG. 3 is an SEM image of an exemplary inventive nonwoven.
Figure 4:
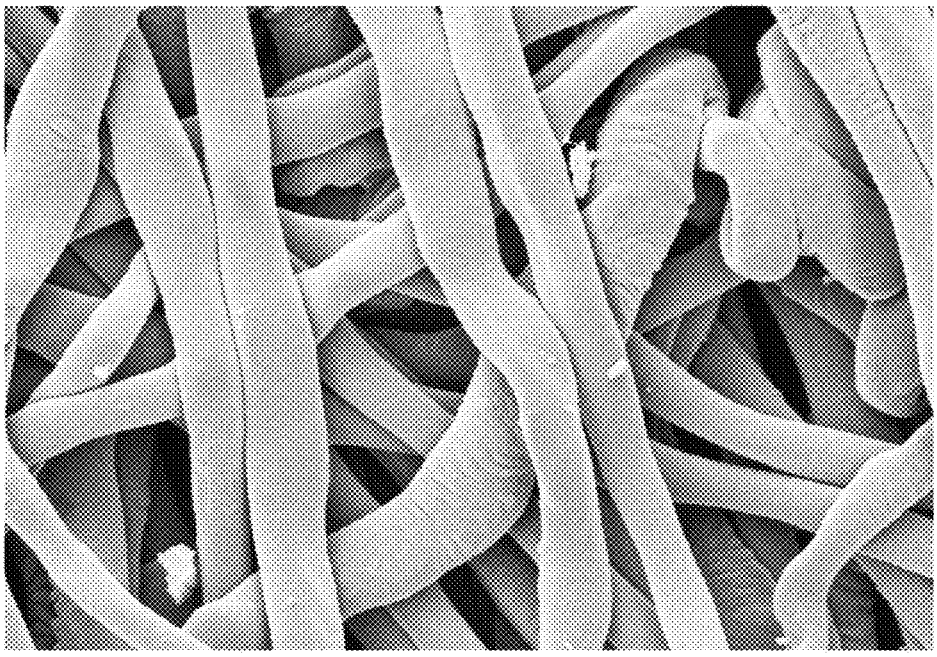
FIG. 4 is an SEM image of fibers within an exemplary inventive nonwoven.
Figure 5:
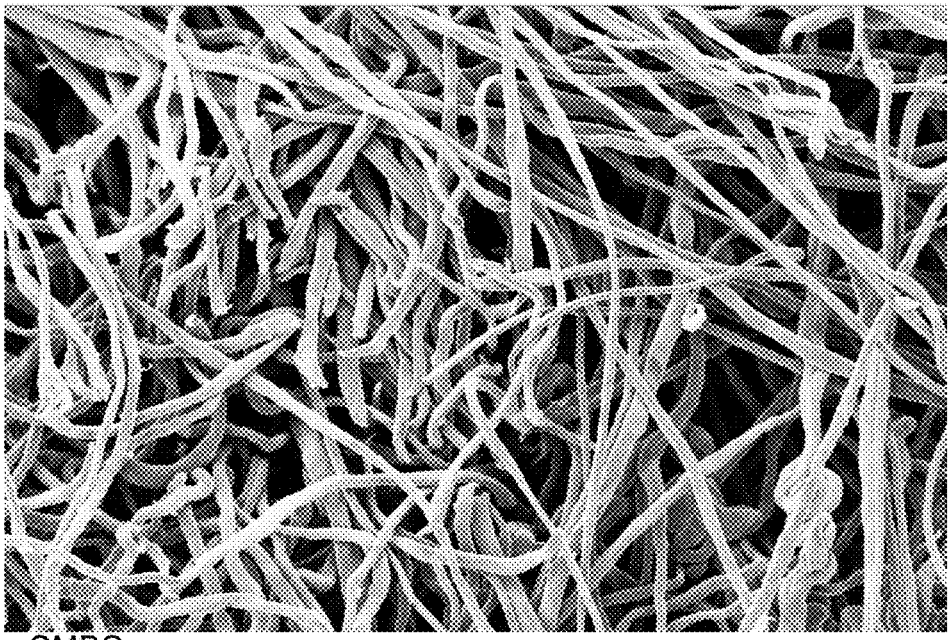
FIG. 5 is an SEM image of an exemplary inventive nonwoven.
Figure 6:
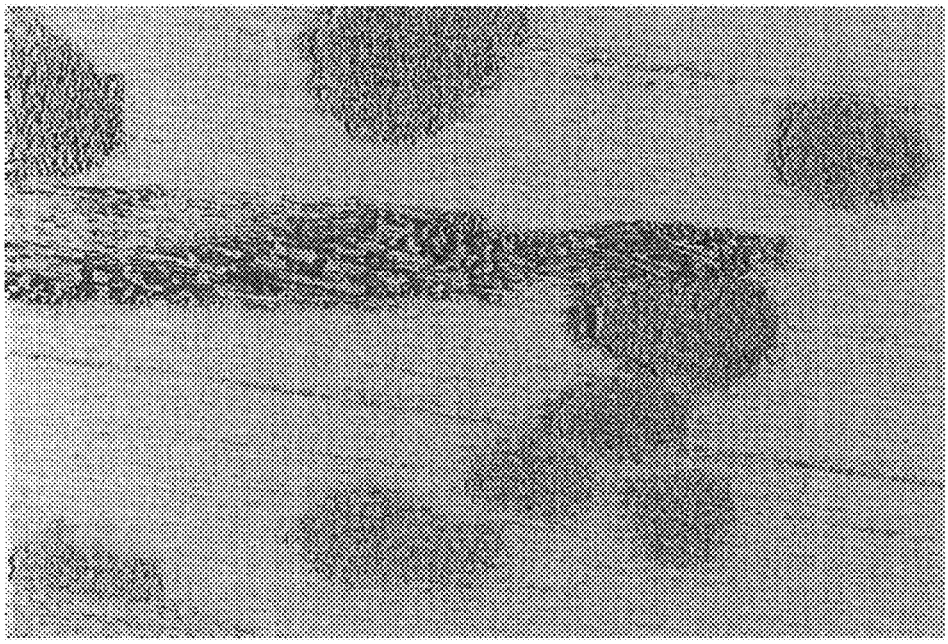
FIG. 6 is an SEM image of a cross-section of an exemplary inventive fiber.

The textile fabrics which are useful for various application sectors depending on the type of functional additives are constructed from additive-containing fibers containing more than 40 wt % and up to 96 wt %, optionally even more, based on total fiber weight in each case, of functional additive and have an average diameter from 0.1 to 500 micrometers. The fraction of functional additives is preferably more than 40 wt % up to 90 wt %, based on total fiber weight, such as from 50 to 75 wt % based on the total fiber weight. The additives are uniformly dispersed throughout the entire cross section of one or more of the fibers in the spunlaid nonwoven, particularly dispersed throughout the entire cross section of any fiber formed in accordance with the invention. FIG. 6 provides a cross sectional view of an inventive fiber, in which rounded particles can be seen embedded within a cellulose matrix. The term "fiber" as used in the present invention is not only used for fibers as a skilled person will know it, i.e. a conventional fiber shape, but also for any fibrous elements extruded during solution spinning, including randomly shaped fibrous masses arising by reason of the numerous breakages in the process of spinning of solutions resulting in fibers with an additive content of up to 96 wt %, based on the total fiber weight.

The incorporated and permanent functions of the additives range for example from electrically conductive, absorbing, ion exchanging, antibacterial, temperature regulating through to abrasive or reconditioning functions, and/or combinations thereof. As used herein, the term "permanent" generally means that the given functionality remains either after 50 washings (or usages) or more (such as for 100 washings and/or usages) or for the entire useful life of the fiber and/or spunlaid nonwoven.

The functional additives are in particular activated carbon, superabsorbents, ion exchange resins, PCM, metal oxides, ceramics, abrasives, zeolites, layered silicates, such as bentonites, or modified layered silicates. Liquid lipophilic substances, such as paraffins, waxes or oils, can also be introduced as functional additive in known processes, such as provided in U.S. Pat. No. 9,303,335. In addition, one or further components can be introduced in minor concentrations, for example nanosilver or dyes or else active ingredients, for example active pharmaceutical ingredients or insecticides or flame retardants, for example melamine compounds.

The volume fraction of functional additives (also referred to herein as functional particles or functional materials) in the constituting mixture has preferably been chosen such that it, at above 50%, comprises the main volume component in the fibers of the obtained spunlaid nonwoven. The volume fraction is calculated based on the density and weight fraction of the additive component. In one particular embodiment, in which the diameter of the functional particles is about ¼ of the average fiber diameter of the spunlaid nonwoven, the individual particles in the fibers have points of contact and so the functional properties can develop in an advantageous manner. Caused by the high content of functional additives there are often arising numerous points of contact between the functional particles, which can lead to improved functional properties, e.g. if electrical conductive additives are used.

The functional fabrics comprising particle-containing fibers are produced via a solution spinning process. A doped polymer-containing spinning solution is used in the fiberization process, the direct solvent preferably being an aprotic solvent. The polymer is a non-meltable polymer, that means that this polymer cannot be processed in a melt. Preferably the polymer is cellulose. Useful direct solvents, especially for cellulose, include particularly N-methylmorpholine N-oxide or N-methylmorpholine N-oxide monohydrate, ionic liquids, such as 1-ethyl-3-methylimidazolium acetate, 3-ethyl-1-methylimidazolium chloride or 3-butyl-1-methylimidazolium chloride, dimethylformamide, dimethylacetamide or dimethyl sulfoxide mixed with lithium chloride or NaOH-thiourea-water or optionally mixtures thereof. The spinning solution with the functional particles and the dissolved polymer is extruded through die holes having a diameter of 0.1 to 1.1 mm and preferably of 0.3 to 0.7 mm at temperature in a range from 90 to 140° C.

The resulting strands are attenuated or drawn immediately upon leaving the die by an oblique, downward directed air stream, the intensity of which is adapted to the reduced thread-drawing capacity of the spun mixture due to the functional particles. Specifically, the intensity of the attenuating air stream may be decreased from 10 to 90% of the intensity that would be used for identical fiber that did not contain filler (i.e. conventional attenuation air intensity), such as 25 to 75% of the conventional attenuation air intensity. Preferably the air stream is moisturized by a non-solvent, such as water, which is blown or sprayed onto the polymeric strands at a distance from the die between 5 to 20 mm, in order to start coagulation and stabilize the form of the extruded fibers and fibrous elements. The angle, at which the water mist is given onto the spun solution jet is between 45° to 90°. Fiber cracks resulting in the process do not lead to discontinuation of the process and have no adverse effect on the step of nonwoven production. The fibers are subsequently (in the course of transitioning into the tensionless space) stabilized in their shape before the onset of longitudinal relaxation. This is accomplished by transforming the dissolved state of the polymer into an at least partially undissolved state by means of a stream of fine droplets, especially of water or an aprotic liquid, by gelation and possible exchange of the solvent. On reaching a tack-free state, the fibers are laid down and respectively sucked onto a foraminous belt or drum to form a nonwoven, which can also be layered, and compacted by aspiration. The excess water enriched with solvent is separated off, the remaining solvent is rinsed out by repeated washing and subsequently the nonwoven obtained can be dried if desired, in which case the functional particles in the nonwoven-constituting fibers become, due to the deswelling of the polymer taking place in the process, mutually touching and joining to an increased extent in a manner which is property determining. The spinning process can be described as following: The spinning solution consisting of cellulose, solvent, preferably NMMO, and finely dispersed additives is extruded and formed through annular die holes. The blowing by an air-stream results in a stretching of the exiting cylindrical solution stream. This stretching is not uniform and is different in comparison to the stretching process of unfilled cellulose solutions or solutions with a low content of additives. Caused by the high additive content, size, type and form of the additive as well as depending on the type of the used cellulose there are sections of higher or thinner diameters within a single, i.e. individual, fiber and even single fiber breakages. This leads to coexistent resulting fibers with different and variable lengths; varying non-uniform diameters even within one fiber (i.e. a single or individual fiber) and often to fibers with conic ends. Consequently, individual fibers of randomly differing length respective to each other are present within a single nonwoven. Simultaneously with the blowing air the fibers are being contacted by a non-solvent for cellulose (water) and the solvent is being exchanged. After the complete removal of the solvent from the fibers and subsequent drying of the resulting spunlaced nonwovens the influence of the incorporated additives on the surface becomes obvious.

Depending on the kind of additive, the additive content, size and shape, the fiber surface can be smooth, coarse, uneven or colored. Fiber surfaces may be gnarled, pitted, have a multitude of crevices and random nodules or may have the appearance of tree-bark, sandpaper, or even popcorn-like. The unique surface appearance of the inventive fibers is reflected in their extreme thickness/diameter) fluctuations. For example, for inventive fibers with a principally or theoretically round cross section, the fibers exhibit non-uniform deviations in the diameter of the single, individual fiber down its length, as well as nonuniform diameter and length deviations between individual fibers and within the same nonwoven. The forming of the fibrous elements of the nonwoven is a stochastic process which cannot be controlled. The effect such stochastic process does have is that individual fibers of varying length and individual fibers having non-uniform, varying diameter down the length of a given fiber and non-uniform diameters between the various fibers at any or all positions down the length of a given fiber are present in a single nonwoven. As used herein, the term "non-uniform" means (i) not constant and (ii) randomly (i.e. indiscriminately and/non-selectively) varying without following a set pattern. The inventive non-uniform fibers thus have fiber diameters that exhibit no repeating pattern or regular sequence down the length of an individual fiber, as illustrated in the SEMs of exemplary inventive nonwovens and fibers containing 50% carbon black particles, provided in FIGS. 1 through 5.

The directly dissolved polymer which binds the particles is a non-melting polymer, i.e., a polymer where the softening point is above the decomposition point. It is preferably a representative from the group of natural polymers, for example from the group of polysaccharides, and more preferably cellulose, of the polysaccharide derivatives and of the proteins or protein derivatives, and/or from the group of solvent-formable synthetic polymers, for example polyacrylonitrile, polyvinyl alcohol, polyethylene oxide, polysulfone, meta-aramid or their copolymers.

The wet spunlaid nonwoven thus obtained can be subjected to textile processes (needling, water jet consolidation, chemical bonding) to consolidate, refine and form it, in which case the consolidating and refining of the nonwoven can take place before or after drying. It was quite surprising that the inventive nonwovens exhibited sufficient strength, in the absence of reinforcement or chemical bonding, to allow needling and/or consolidation. In advantageous embodiments the needling and/or consolidation compacts the nonwoven by at least 10%, such as by at least 30%, relative to its initial thickness. An aftertreatment by, for example, coating, impregnating with active ionic ingredients can follow.

A spunlaid nonwoven is a nonwoven of fibers (which may further include fiber bundles and fibrils, as noted above) which is randomly laid down directly after solution spinning, and two or more plies can also be laid on top of one another. The mixture of fibers is the result of fiber breakages below the die which result from the high particle content but which do not lead to any interruption of the process. Moreover, the spunlaid nonwoven of the process according to the present invention does not consist of just individual fibers differing in length within the same nonwoven, but each individual fiber has different, random thicknesses (e.g. diameters) along its length and such random fiber thicknesses differ between each of the fibers within a single nonwoven. Fiber thickness is determined by various factors, such as the concentration of the solution, the spinning and blowing rate, the diameter of the die holes, the type of polymer, the particle size, and also the interaction of additives with other components of the solution and additive content. At laydown, intertwined and entangled fibers are produced and a firmly interbonded nonwoven is then formed, which can undergo a textile processing and exhibits permanent functional properties depending on the integrated additives. The high inventive particle content, the particle size and the fiber breakages result in fibers incorporating characteristic, random nonuniformities in the average diameter of the fibers, which are very readily visible under a microscope.

The advantage of producing the fabric from solutions of polymers versus production from polymer melts is that the particle content can be immeasurably higher, since solvent is present in the starting solution alongside polymer and additive and this solvent is then removed at a later time, generally after stretching. The network of the dissolved polymer in solvent thus retains its glidability in order that the particles may glide past one another during extrusion through the spinnette and subsequent stretching. In addition, various gel states of the fibers due to the exchange of the solvent for water can be utilized for further processing. The fibers in the spunlaid nonwoven may be glued together at intersecting points, via application of a bonding agent or the like to the formed nonwoven. Thereby, e.g. the strength of the spunlaid nonwovens in longitudinal and lateral direction as well as their stiffness may be adjusted as needed. In alternative embodiments, the inventive nonwovens exhibit sufficient nonwoven cohesion, due to improved entanglements provided by the inventive random fibers, that bonding agent and the like are not required.

The high-functionality spunlaid nonwoven has a weight per unit area of 2 to 1000 g/m$^2$ and preferably of 5 to 500 g/m$^2$ and a thickness of 0.01 to 20 mm and preferably of 0.05 to 5 mm. It possesses additional incorporated and permanent functions based on its additive's properties, such functionality includes, for example, electrically conductive, absorbing, ion exchanging, antibacterial, temperature regulating, flame retardant, abrasive, reconditioning functions or combinations thereof. As used herein the term "high-functional" and "high-functionality" means that the functionality imparted by the particles is more elevated and works permanently in comparison to functionality provided by conventional nonwovens, such as nonwovens whose fibers do not include particles extruded therein, but which only have particles on its surface. Such higher functionality can range from 10 to 90% higher, such as 25 to 75% higher than conventional nonwovens whose fibers do not include particles extruded therein.

In one particular embodiment, pore-forming agents which are particulate, for example Glauber's salt, can be integrated into the polymer solution. In the spunlaid nonwoven produced, the pore-forming agents then lead, during the washing process, to a spunlaid nonwoven of high-porosity fibers which, compared with sheet-like sponges, have a very much higher surface area.

The use of a high-functionality spunlaid nonwoven comprising particle-containing fibers ranges from apparel textiles, for example interlinings which store heat or deliver active ingredients, to industrial textiles with high functional benefit for various application sectors depending on the type of functional particles, for example for hygiene applications, as wound dressings, as carrier materials for active ingredients or as carrier materials in composites, as building and transportation material, as insulation material, as cosmetic material or as filters, for example for the filtration and binding of air and water ingredients such as phosphates, nitrates and ammonium-nitrogen compounds. Owing to the permanent special manifestation of functional properties, due to the high concentration of additives, these fibrous nonwovens are also suitable for layered composites with other fabrics. This can be accomplished by producing the high-functionality spunlaid nonwoven on another, previously laid fabric during spunlaid nonwoven production.

The examples which follow serve to illustrate the invention. Percentages therein are by weight, unless otherwise stated or immediately apparent from the context.

EXAMPLE 1 (COMPARATIVE)

A 0.1 kg quantity of a ground ion exchange resin (strong basic anion exchanger) having a particle diameter of $D_{99}$=14.8 μm was dispersed in 1.5 kg of a 9% cellulose solution in N-methyl-morpholine N-oxide monohydrate (NMMO monohydrate) followed by homogenizing at 90° C. for 30 minutes. The spinning solution was subsequently gear pumped at 95° C. to a spinneret die (1200 circular holes having a diameter of 0.3 mm) and spun. However, consistent forming via an air gap (1=10 mm) was not possible because the emerging jets of solution became coalesced at the spinneret exit. Some of the fiber tow pieces formed were completely freed of solvent and, as far as possible, cut to a staple length of 40 mm, with the coalesced regions described being screened out as far as possible. The fibers were treated with a 1% sodium chloride solution and dried at 55° C. to constant weight. Secondary spinning into yarn was not possible. Nonwoven production was only marginally possible with a large number of short fibers and extreme truncation of the fibers being observed. The irregular looser portions of nonwoven were not further processable/utilizable. Consolidation by needling for stabilization was not possible since the nonwoven became completely destroyed in the process and disintegrated.

EXAMPLE 2

A cellulose solution produced as per Example 1 was solidified via solution spinning process (solution blowing) at a solution temperature of 95° C., a blown with warm air at 80° C. and spraying with a water mist immediately on exit from the die blow unit and formed into a direct nonwoven by laydown on a foraminous belt. The forming operation was stable and the nonwoven obtained was, following complete extraction of the solvent and drying at 60° C., readily usable as ion exchange nonwoven. The functional nonwoven was mechanically so stable that it could be cut to size and introduced into the water treatment rig. An additionally performed moderate needling and thus further compaction was likewise possible without the nonwoven becoming destroyed in the process.

EXAMPLE 3

Figure 7:
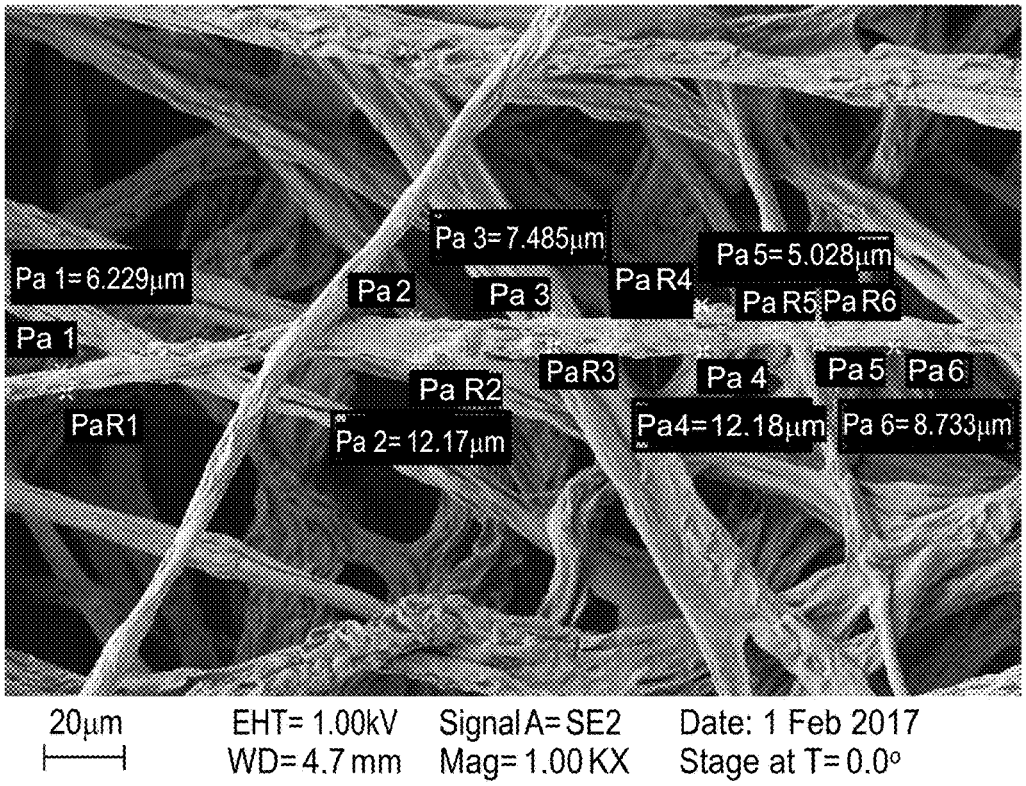
FIG. 7 is an REM image of an inventive nonwoven in accordance with Example 3.
Figure 8:
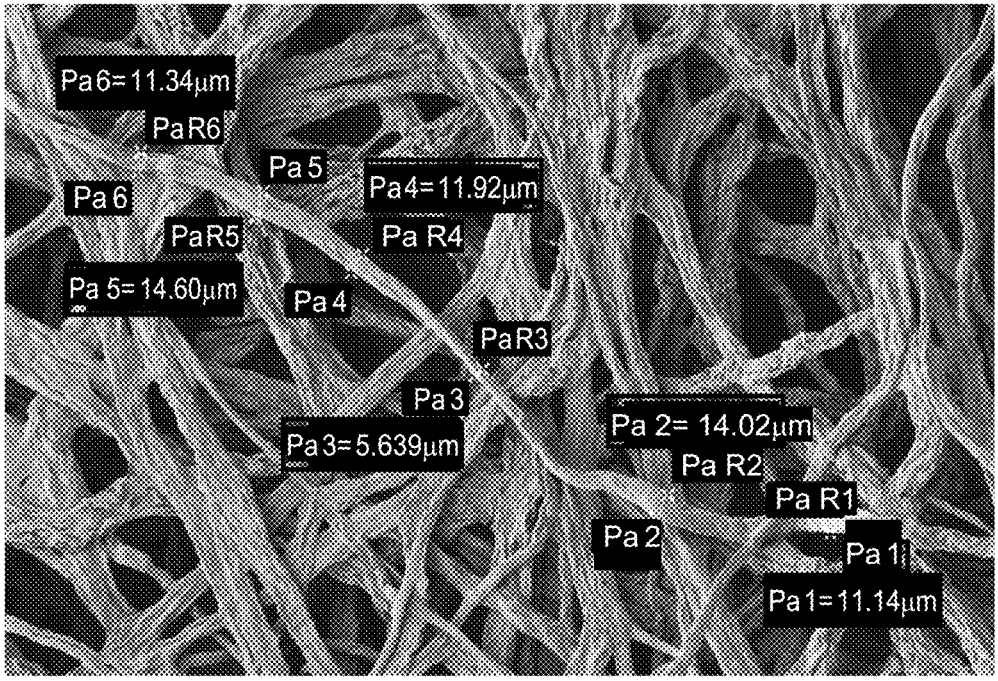
FIG. 8 is an REM image of an exemplary inventive nonwoven in accordance with Example 3.
Figure 9:
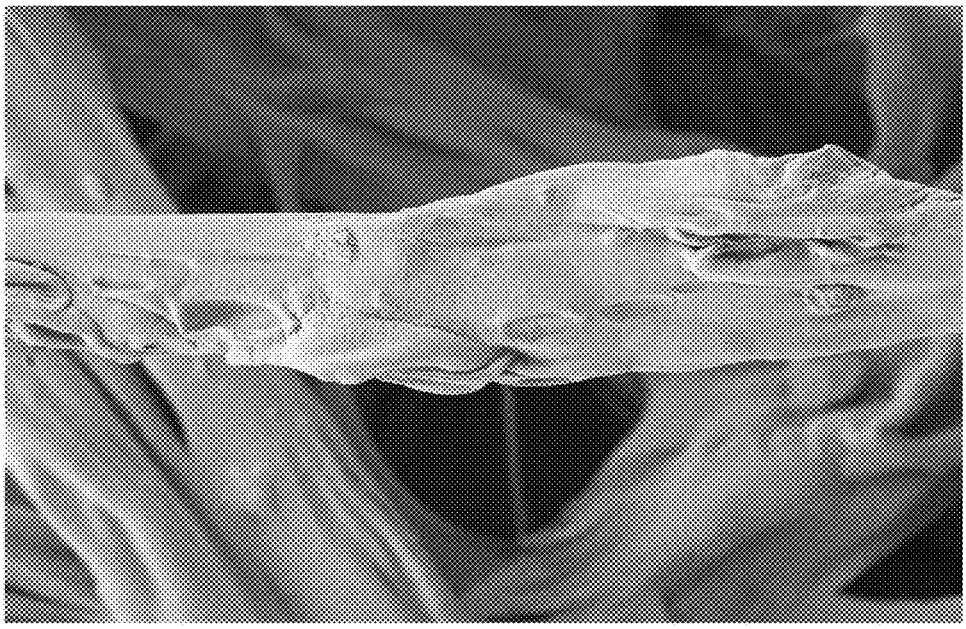
FIG. 9 is an REM image of a fiber within an exemplary inventive nonwoven in accordance with Example 3.

104 g of sodium polyacrylate (Super Absorbent Polymer, SAP, Product no. Z 3162 of Stockhausen GmbH; particle diameter D50=5 μm; D100<100 μm) were mixed intensely with 2291 g of 60 mass-% aqueous NMMO. 100 g of crushed cellulose were added to the mixture. The mixture was heated under vacuum to a temperature of the solution of 95° C. until a complete dissolution was observed. Surplus water was removed by the vacuum in order to get a 0.8 to 1.2 monohydrate NMMO. The dissolution state of the cellulose was controlled using a micro-picture in thin film. The spinning solution was subsequently gear pumped at 95° C. to a spinneret die (30 circular holes having a diameter of 0.5 mm) and spun at 105° C. The composition of the spinning solution is shown in table 1. The polymer strands exiting the spinneret were sprayed with a water mist immediately on exit from the die, at a distance of 5 to 10 mm to initiate coagulation. Subsequent to coagulation initiation, the fibers were form-stabilized and then laid down on a foraminous belt and washed and dried. A nonwoven was obtained having an additive content of 50.91 mass-% of solid additives. The additives were homogeneously dispersed over the cross-section of the fibers. FIG. 7 shows the obtained spunlaid nonwoven 1,000 times magnified by a reflection electron microscope ("REM"). As shown in Picture 7, the surface of the individual fibers making up the nonwoven are gnarled and creviced rather than smooth. FIG. 8 shows a 500 times magnified REM picture of the obtained nonwoven, with several of the fibers appearing fused, and random variations in individual fiber diameter evident. FIG. 9 shows a 5,000 times magnified section of a fiber of this nonwoven, clearly illustrating the extreme non-uniformity of inventive fibers, with the surface of the individual fiber including pits, clumps, and crevices. The water retention (WRV), determined according to DIN53814, of such a nonwoven showed the following parameters in dependence on the weight per unit area: 70 g/m$^2$ nonwoven translated to WRV 176%, 200 g/m$^2$ nonwoven translated to WRV 633%. This material can be used for high liquid retention applications, such as sanitary articles (diapers, incontinence inlays, sanitary napkins, and similar goods), wound management, nonwoven with ion exchange functionalities, nonwoven with water retention functionalities in agriculture and horticulture.

EXAMPLE 4

Figure 10:
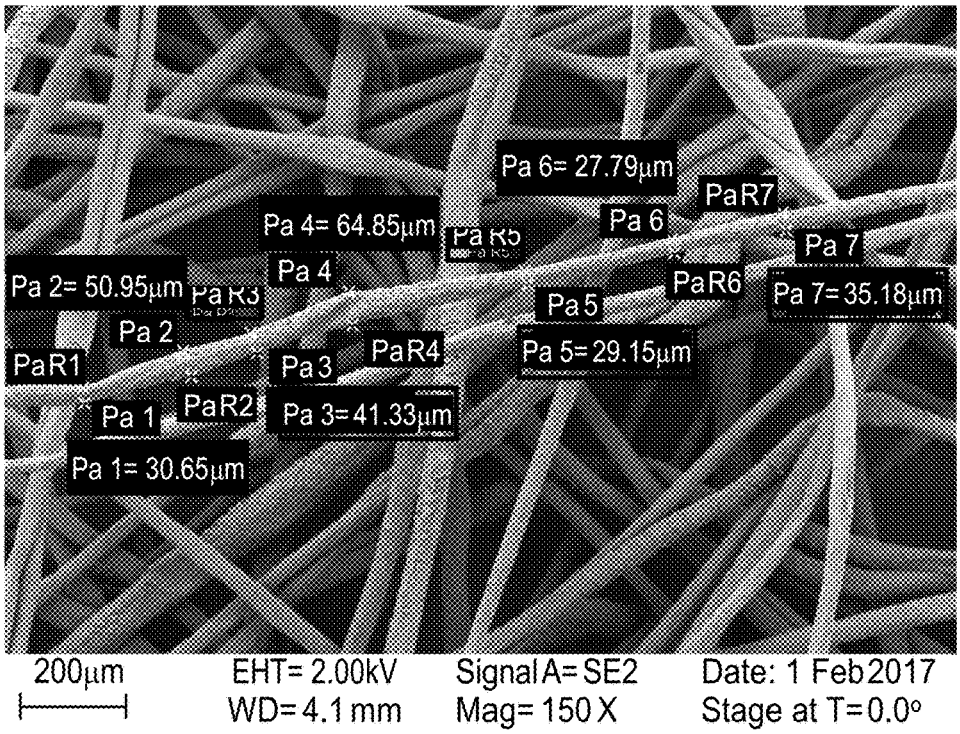
FIG. 10 is an REM image of an exemplary inventive nonwoven in accordance with Example 4.
Figure 11:
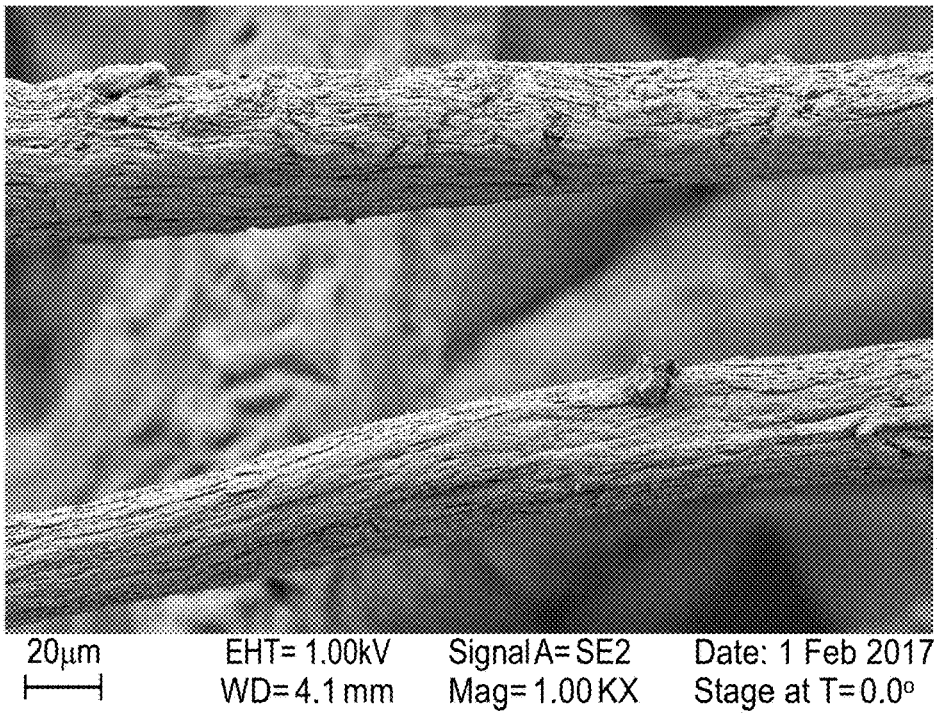
FIG. 11 is an REM image of fibers within an exemplary inventive nonwoven in accordance with Example 4.

2,430 g of a paraffin melting at 18° C. (technical purity >97%, C-16 n-paraffin (n-hexadecane) PARAFOL® 16-97, co Sasol Ltd., density at 40° C.: 0.768 g/cm$^3$) together with 373 g of a mixture of hydrophobized layered silicate and high-dispersed silica were mixed intensely with 15,960 g of 60 mass-% aqueous NMMO. 1,027 g of crushed cellulose were added to the mixture. The mixture was heated under vacuum to a temperature of the solution of 95° C. until a complete dissolution was observed. The dissolution state of the cellulose was controlled using a micro-picture in thin film. The spinning solution was subsequently gear pumped at 95° C. to a spinneret die (30 circular holes having a diameter of 0.5 mm) and spun at 105° C. The composition of the spinning solution is shown in table 1. The polymer strands exiting the spinneret were sprayed with a water mist immediately on exit from the die, at a distance of 5 mm, to initiate coagulation. Subsequent to coagulation initiation, the fibers were form-stabilized and then blown and respectively sucked onto a foraminous belt and washed and dried. The fibers of the obtained nonwoven had an additive content of 73.2 mass-% of additives. The additives were homogeneously dispersed over the cross-section of the fibers. FIG. 10 shows the obtained spunlaid nonwoven 150 times magnified by a REM, illustrating several twisted fibers, large individual fiber diameter fluctuations, and a roughened fiber surface. FIG. 11 shows a 1,000 times magnified section of a fiber of this nonwoven, illustrating the unusual, tree-bark-like appearance of the inventive fiber surface, which likewise includes crevices and lumps. The heat storage capacity of the obtained spunlaid nonwoven measured by DSC was ≥135 J/g.

EXAMPLE 5

2.430 g of a paraffin melting at 28° C. (technical purity >97%; C-18 n-paraffin (n-octadecane) PARAFOL® 18-97, co. Sasol Ltd.; density at 40° C.: 0.776 g/cm$^3$) together with 373 g of a mixture of hydrophobized layered silicate and high-dispersed silica were mixed intensely with 15,960 g of 60 mass-% aqueous NMMO. 1,027 g of crushed cellulose were added to the mixture. The mixture was heated under vacuum to a temperature of the solution of 95° C. until a complete dissolution was observed. The dissolution state of the cellulose was controlled using a micro-picture in thin film. The spinning solution was subsequently gear pumped at 95° C. to a spinneret die (30 circular holes having a diameter of 0.5 mm) and spun at 105° C. The composition of the spinning solution is shown in table 1. The polymer strands exiting the spinneret were sprayed with a water mist immediately on exit from the die, at a distance of 10 mm, initiating fiber coagulation. Subsequent to coagulation initiation, the fibers were form-stabilized and then blown respectively sucked on to a foraminous belt and washed and dried. The fibers of the obtained nonwoven had an additive content of 73.2 mass-% of additives. The additives were homogeneously dispersed over the cross-section of the fibers. The heat storage capacity of the obtained spunlaid nonwoven measured by DSC was ≥140 J/g.

EXAMPLE 6

2,800 g of calcium carbonate (density 2.71 g/cm$^3$, particle diameter $D_{50}$=5 μm; $D_{100}$<100 μm) were mixed intensely using an ultrasonic probe with 26,900 g of 60 mass-% aqueous NMMO. 1,500 g of crushed cellulose was added to the mixture. The mixture was heated under vacuum to a temperature of the solution of 95° C. until a complete dissolution was observed. The dissolution state of the cellulose was controlled using a micro-picture in thin film. The spinning solution was subsequently gear pumped at 95° C. to a spinneret die (30 circular holes having a diameter of 0.5 mm) and spun at 95° C. The composition of the spinning solution is shown in table 1. The polymer strands exiting the spinneret were sprayed with a water mist immediately on exit from the die, at a distance of 15 mm, initiating fiber coagulation. Subsequent to coagulation initiation, the fibers were form-stabilized and then blown and respectively sucked onto a foraminous belt and washed and dried. The fibers of the obtained nonwoven had an additive content of 65.1 mass-% of solid additives. The additives were homogeneously dispersed over the cross-section of the fibers. Such nonwovens can be used in cigarette filters, in gas filtration and in water treatment for deacidification of the water.

EXAMPLE 7

Figure 12:
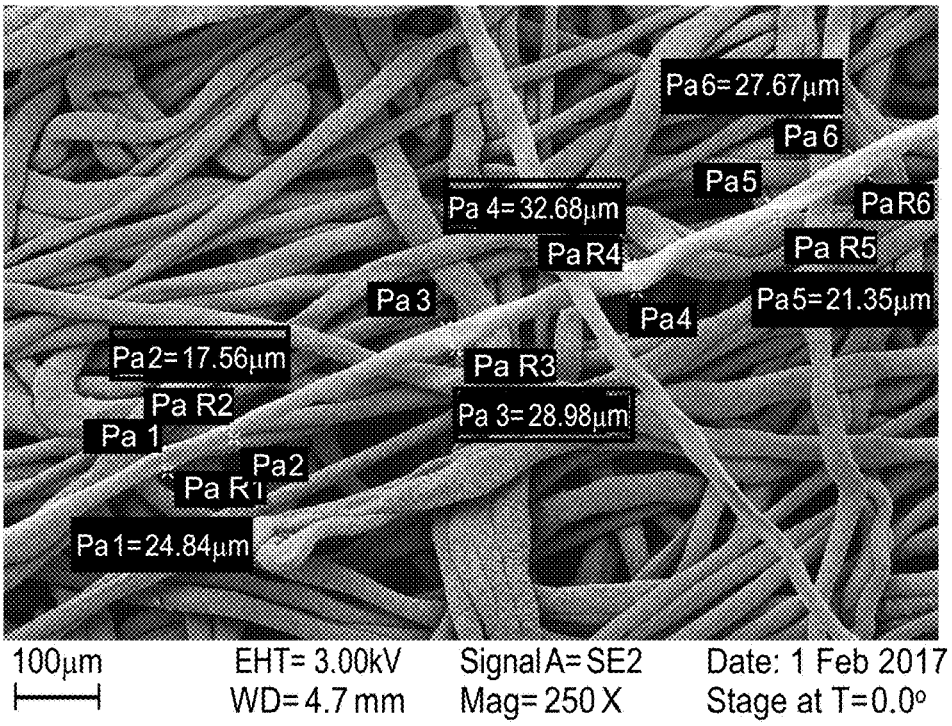
FIG. 12 is an REM image of an exemplary inventive nonwoven in accordance with Example 7.
Figure 13:
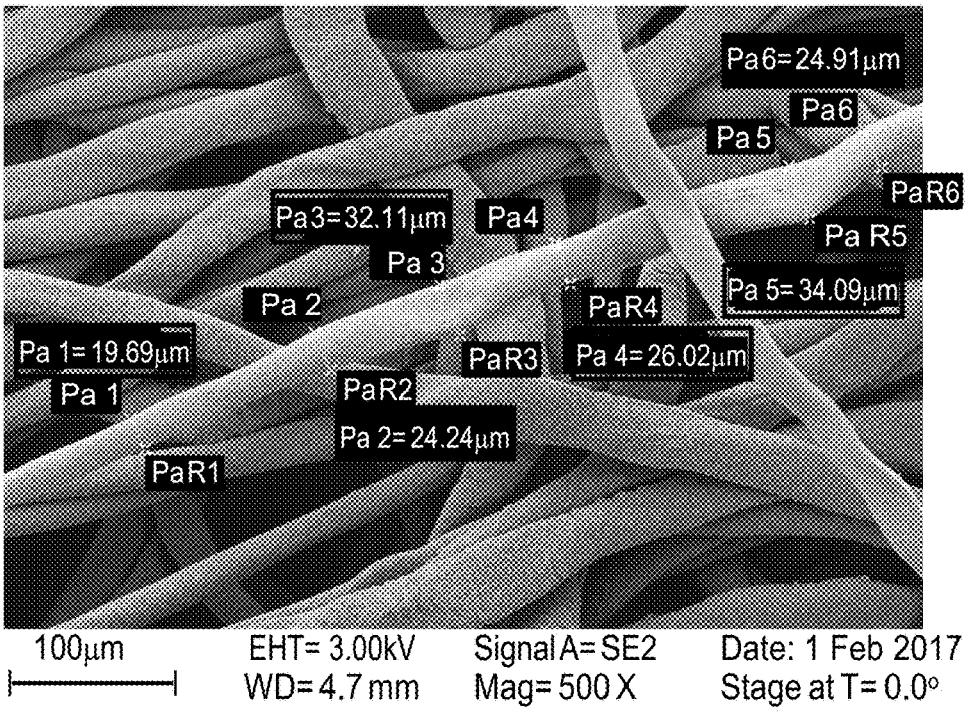
FIG. 13 is an REM image of an exemplary inventive nonwoven in accordance with Example 7.
Figure 14:
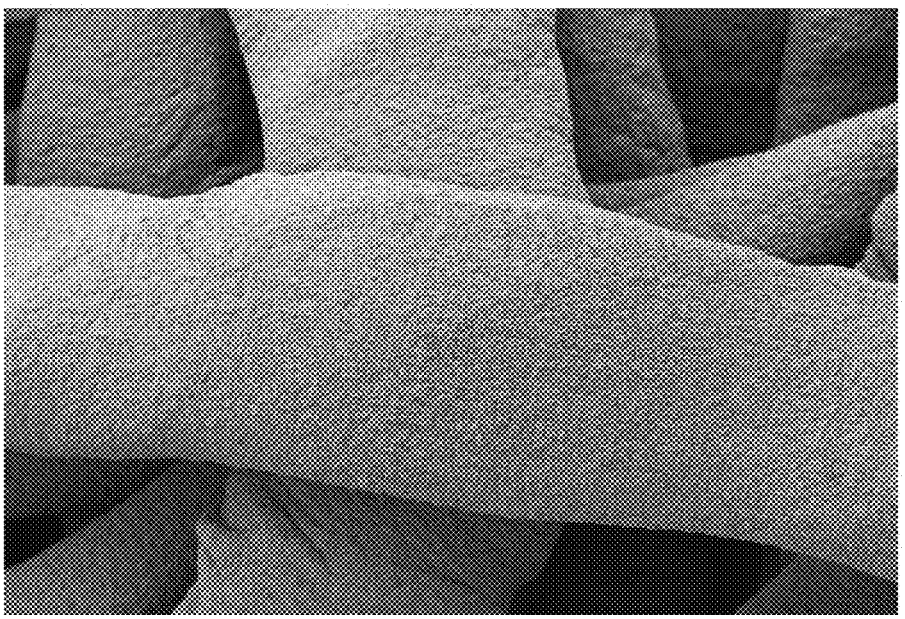
FIG. 14 is an REM image of fiber within an exemplary inventive nonwoven in accordance with Example 7.

4,200 g of carbon black (PRINTEX®; density 1.5 g/cm$^3$, average primary particle size 23 nm) were mixed intensely with 60,500 g of 60 mass-% aqueous NMMO. 4,453 g of crushed cellulose was added to the mixture. The mixture was heated under vacuum to a temperature of the solution of 90° C. until a complete dissolution was observed. The dissolution state of the cellulose was controlled using a micro-picture in thin film. The spinning solution was subsequently gear pumped to a spinneret die (30 circular holes having a diameter of 0.5 mm) and spun at 90° C. The composition of the spinning solution is shown in table 1. The polymer strands exiting the spinneret were sprayed with a water mist immediately on exit from the die, at a distance of 8 mm, initiating fiber coagulation. Subsequent to coagulation initiation, the fibers were form-stabilized and then blown and respectively sucked on to a foraminous belt and washed and dried. The fibers of the obtained nonwoven had an additive content of 48.5 mass-% of PRINTEX® additives. The additive particles were homogeneously dispersed over the cross-section of the fibers. FIG. 12 shows the obtained spunlaid nonwoven by a REM 250 times magnified and FIG. 13 a 500 times magnified picture, illustrating the random, non-uniform fiber diameter fluctuations. FIG. 14, obtained by REM, shows a 2.500 times magnified section of a fibrous component of this nonwoven, clearly illustrating the sand paper-like surface of the individual fibers.

EXAMPLE 8

Figure 15:
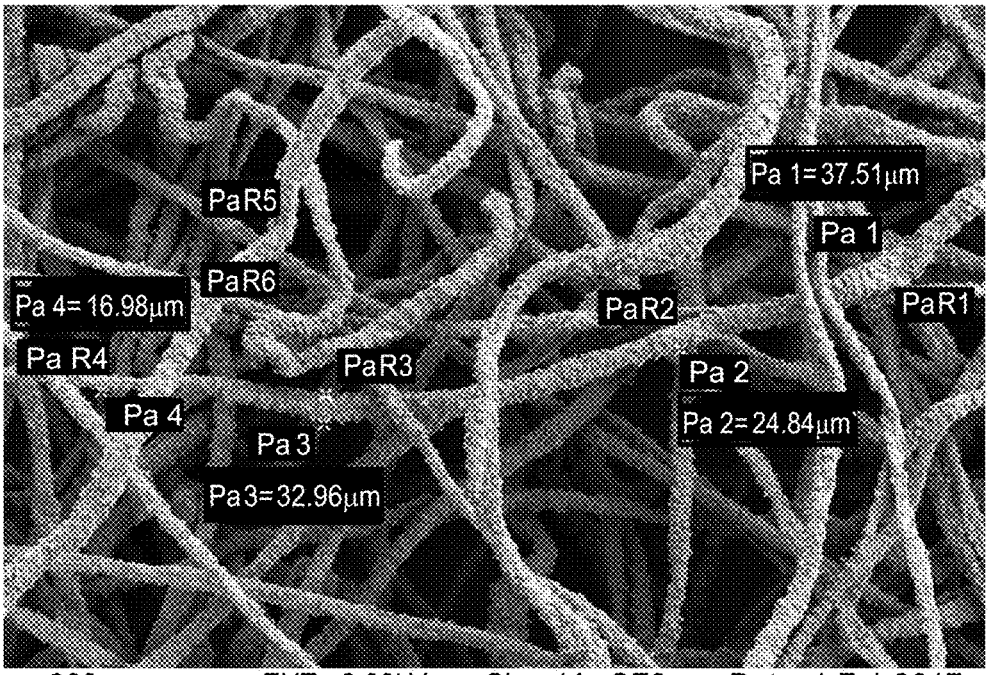
FIG. 15 is an REM image of an exemplary inventive nonwoven in accordance with Example 8.
Figure 16:
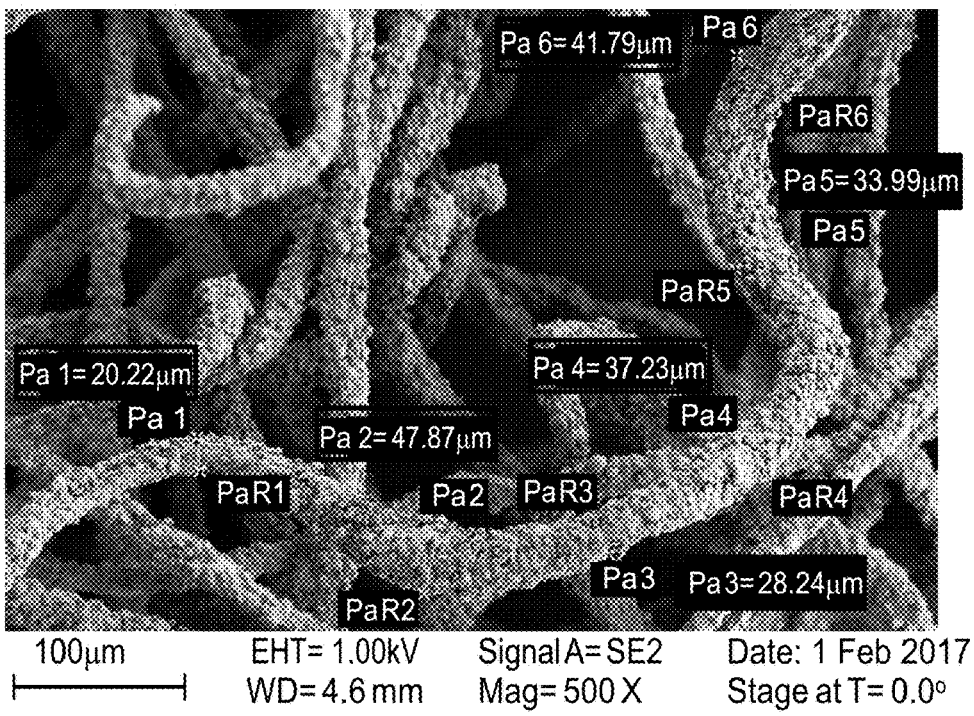
FIG. 16 is an REM image of an exemplary inventive nonwoven in accordance with Example 8.
Figure 17:
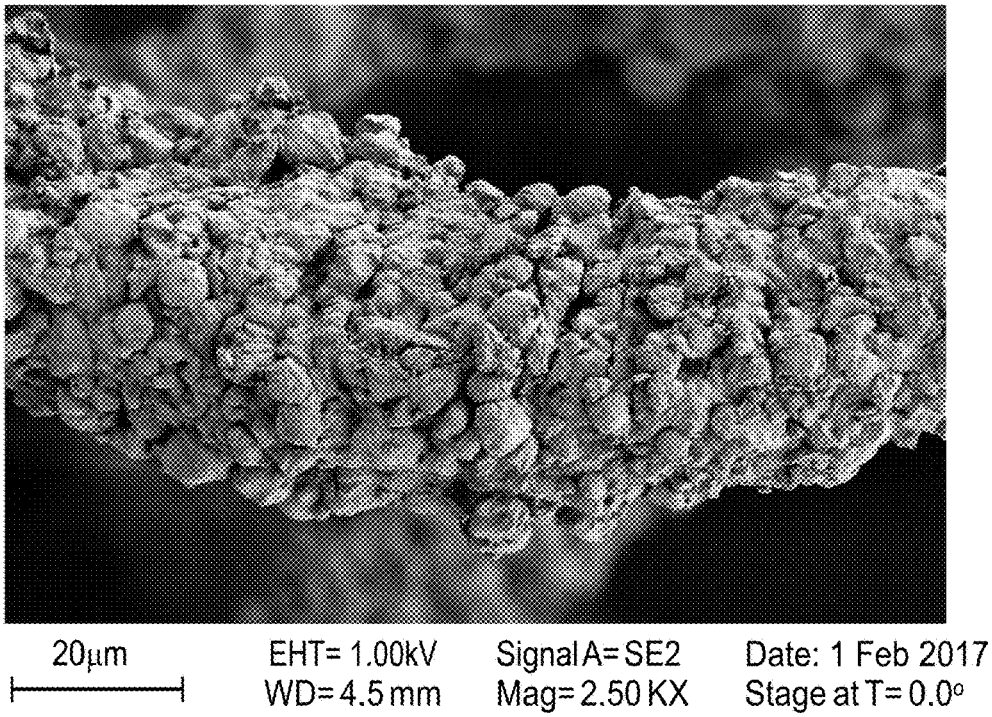
FIG. 17 is an REM image of fiber within an exemplary inventive nonwoven in accordance with Example 8.

1,904 g of zirconium oxide (density 5.7 g/cm$^3$, particle diameter $D_{50}$=1.5 μm, $D_{98}$=73 μm) were mixed intensely by an ultrasonic probe with 3,302 g of 60 mass-% aqueous NMMO. 96 g of crushed cellulose were added to the mixture. The mixture was heated under vacuum to a temperature of the solution of 90° C. until a complete dissolution was observed. The dissolution state of the cellulose was controlled using a micro-picture in thin film. The spinning solution was subsequently gear pumped to a spinneret die (30 annular holes having a diameter of 0.5 mm) and spun at 105° C. The composition of the spinning solution is shown in Table 1. The polymer strands exiting the spinneret were sprayed with a water mist immediately on exit from the die, at a distance of 5 to 10 mm initiating fiber coagulation. Subsequent to coagulation initiation the fibers were form-stabilized and then blown and respectively sucked on to a foraminous belt and washed and dried. The fibers of the obtained nonwoven had an additive content of 94.9 mass-% of solid additives. The additive particles were homogeneously dispersed over the cross-section of the fibers. FIG. 15 shows the obtained spunlaid nonwoven 250 times magnified by a REM and FIG. 16 a 500 times magnified picture by a REM, illustrating the extraordinarily rough surface of the inventive fibers having non-uniform diameters down their length and in comparison to each other, as well as fibers exhibiting a conical-shaped fiber end (i.e. a broken end). FIG. 17 shows a 2,500 times magnified section of a fibrous component of this nonwoven, evidencing the severely coarse surface of the individual fibers, which are covered in a multitude of popcorn-shaped nodules that are both randomly sized and randomly positioned along the length of the fiber.

EXAMPLE 9

1,487 g of corundum (density 3.95 g/cm$^3$, particle diameter $D_{100}$<100 μm) were mixed intensely by an ultrasonic probe with 3,413 g of 60 mass-% aqueous NMMO. 100 g of crushed cellulose were added to the mixture. The mixture was heated under vacuum to a temperature of the solution of 90° C. until a complete dissolution was observed. The dissolution state of the cellulose was controlled using a micro-picture in thin film. The spinning solution was subsequently gear pumped to a spinneret die (30 circular holes having a diameter of 0.5 mm) and spun at 105° C. The composition of the spinning solution is shown in table 1. The polymer strands exiting the spinneret were sprayed with a water mist immediately on exit from the die, at a distance of 10 mm, initiating fiber coagulation. Subsequent to coagulation initiation the fibers were form-stabilized and then blown and respectively sucked onto a foraminous belt and washed and dried. The fibers of the obtained nonwoven had an additive content of 93.7 mass-% of solid corundum additives. The additive particles were homogeneously dispersed over the cross-section of the fibers.

TABLE 1

Results of the spinning trials (examples 3-9)

| Example | Additive | Ratio of the solid content in the fiber [%] | | Total solid content in the spinning dope, [%] | Applications |
|---|---|---|---|---|---|
| | | Cellulose | Additive | | |
| 3 | SAP 3162 | 49.0 | 51.0 SAP & auxiliary | 11.32 | Filter material diapers |
| 4 | PARAFOL ® 16 | 26.8 | 73.2 Parafol & auxiliary | 25.6 | Heat storage or active substances releasing interlinings for clothing, sleeping bags, wound dressings |

TABLE 1-continued

Results of the spinning trials (examples 3-9)

| Example | Additive | Ratio of the solid content in the fiber [%] Cellulose | Additive | Total solid content in the spinning dope, [%] | Applications |
|---|---|---|---|---|---|
| 5 | PARAFOL ® 18 | 26.8 | 73.2 Parafol & auxiliary | 25.6 | Heat storaging or active substances releasing interlinings for clothing, sleeping bags, wound dressings |
| 6 | $CaCO_3$ | 34.9 | 65.1 $CaCO_3$ | 18.6 | Cigarette filter, absorbing material for gas filtration, water treatment (neutralization) |
| 7 | PRINTEX ® | 51.5 | 48.5 Printex | 17.0 | Heating mats |
| 8 | Zirconium oxide | 4.8 | 95.2 $ZrO_2$ | 46.5 | Batteries, inlinings, heat protection, oven cloth |
| 9 | Corundum | 6.3 | 93.7 | 40.0 | Abrasives |

(Percentages in the Table are Mass-Percentages)

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

Ranges enumerated herein also include all integers subsumed therein and fractions thereof.

That which is claimed:

1. A spunlaid nonwoven comprising fibers formed from nonmeltable cellulose polymer as fiber-forming material containing one or more functional additives and providing permanent functional properties, wherein the fibers are intertwined and entangled, have differing lengths, have aspect ratios above 1000 and form an interbonded nonwoven, the fibers have an average diameter of 0.1 to 500 micrometers and also random diameter fluctuations of at least 30% within any one fiber as well as between fibers and the fibers in addition to the nonmeltable cellulose polymer contain permanently more than 40 wt %, based on total fiber weight, of functional additives in solid and/or liquid form that are finely distributed within the cross-section of the fibers and which are enclosed by the cellulose polymer matrix material.

2. The spunlaid nonwoven as claimed in claim 1, wherein the nonwoven comprises fibers having different, random lengths in comparison to each other and fibers having broken ends.

3. The spunlaid nonwoven as claimed in claim 1, wherein the functional additives are lipophilic substances, activated carbon, superabsorbent polymers, ion exchange resins, metal oxides, ceramics, abrasives, zeolites, layered silicates, or mixtures thereof.

4. The spunlaid nonwoven as claimed in claim 1, wherein the nonmemeltable cellulose polymer binding the functional additives is a solution-formable polymer and the polymer is insoluble in water.

5. The spunlaid nonwoven as claimed in claim 1, wherein the volume fraction of the additives is ≥50% in the dried fibers.

6. The spunlaid nonwoven as claimed in claim 1, Wherein said nonwoven has a weight per unit area of 2 to 1000 $g/m^2$.

7. The spunlaid nonwoven as claimed in claim 1, wherein said nonwoven has a thickness of 0.01 to 20 mm.

8. The spunlaid nonwoven as claimed in claim 1, wherein the fraction of functional additives is up to 96 wt %, based on total fiber weight and the additives are incorporated in the fibers permanently.

9. The spunlaid nonwoven as claimed in claim 2, wherein the functional additives are activated carbon, superabsorbents, ion exchange resins, piezoelectric materials, phase change materials, metal oxides, flame retardants, abrasives, zeolites, sheet-silicates, modified sheet-silicates and/or cosmetics.

10. The spunlaid nonwoven as claimed in claim 2, wherein the functional lipophilic additives are paraffins.

11. A process for producing a high-functionality spunlaid nonwoven as claimed in claim 1, comprising extruding a spinning solution comprising more than 40 wt % of one or more functional additives, solvent and dissolved polymer through a spinneret die, the die having holes with a diameter of 0.1 to 1.5 mm, to form polymeric strands;

drawing the resulting polymeric strands into fibers, said drawing commencing immediately upon leaving the die, said drawing effected by an obliquely downwardly directed blowing stream the intensity of which is adapted to the reduced thread-drawing capacity of the spun mixture due to the functional additives, in addition to the air stream the strands are blown or sprayed on by a non-solvent starting at a distance between 5 to 20 mm, said drawing performed within a short path, in the longitudinal direction, subsequently stabilizing the drawn fibers upon transitioning into a tensionless space, even before the onset of longitudinal relaxation, said fibers stabilized in their shape via a stream of temperature-controlled air and fine droplets of a non-solvent by consolidation/gelation and partial replacement of the solvent with the non-solvent, wherein in spatial terms the stabilization can take place more or less offset to the die exit and gel-state fibers are obtained, forming a nonwoven by laying down the stabilized fiber on a foraminous belt or drum, rinsing out the remaining solvent by repeated washing and optionally drying the nonwoven wherein the solvent is a direct solvent for the polymer, and the solvent is selected from N-methylmorpholine N-oxide, N-methylmorpholine N-oxide monohydrate, ionic liquids or mixtures thereof.

12. The process as claimed in claim 11, wherein the high-functionality spunlaid nonwoven is further consolidated, refined and formed by textile processes, and the consolidating and refining of the nonwoven is effected before or after drying.

13. The process as claimed in claim 11, wherein the high-functionality spunlaid nonwoven is stabilized by needling or water jet consolidation and/or additionally subjected to chemical crosslinking.

14. Apparel textiles or industrial textiles comprising a spunlaid nonwoven as claimed in claim 1.

15. Apparel textiles or industrial textiles as claimed in claim 14, wherein the apparel textiles are interlinings, and the industrial textiles are hygiene textiles, wound dressings, carrier materials for active ingredients, carrier materials for composites, building material, transportation material, cosmetic material, electrical conductive material, polishing material or filters.

16. The spunlaid nonwoven as claimed in claim 1, wherein the random, non-uniform diameter fluctuations are down the length of the fiber, and the cellulose is formed using a direct solvent selected from N-methylmorpholine N-oxide, N-methyimorpholine N-oxide monohydrate, ionic liquids or mixtures thereof.

17. The spunlaid nonwoven as claimed in claim 1, wherein said fibers have a roughened surface with crevices.

18. The spunlaid nonwoven as claimed in claim 1, wherein the function is electrical conductivity, absorption, ion exchange, temperature regulation, abrasion and combinations thereof.

* * * * *